US005619019A

United States Patent [19]

Yoshimura et al.

[11] Patent Number: 5,619,019

[45] Date of Patent: Apr. 8, 1997

[54] DAMPER FOR LOUDSPEAKER

[75] Inventors: Takeshi Yoshimura, Tokyo; Koichi Morioka; Teruho Yamada, both of Hyogo, all of Japan

[73] Assignees: Mitsubishi Denki Kabushiki Kaisha; Foster Electric Co., Ltd., both of Tokyo, Japan

[21] Appl. No.: 458,108

[22] Filed: Jun. 1, 1995

[30] Foreign Application Priority Data

Oct. 7, 1994 [JP] Japan ..... 6-244279

[51] Int. Cl.[6] ..... H04R 7/00

[52] U.S. Cl. ..... 181/166; 181/174

[58] Field of Search ..... 181/166, 167, 181/169, 171, 172, 173, 174

[56] References Cited

U.S. PATENT DOCUMENTS 4,030,564 6/1977 Itagaki ..... 181/166

4,239,944 12/1980 Obara et al. ..... 181/171

FOREIGN PATENT DOCUMENTS 1487376 2/1969 Germany .

3511802 10/1986 Germany .

511693 2/1993 Japan .

662494 3/1994 Japan .

*Primary Examiner*—Khanh Dang

[57] ABSTRACT

A damper for a loudspeaker has an improved linearity of the amount of strain caused by the vibrational energy to vibrational energy exerted on the damper to enable the loudspeaker to reproduce sounds in a high fidelity. The damper is formed such that the modulus of elasticity with respect to a direction perpendicular to the surface of the damper is uniform on a circle with its center at the center of the damper, and portions respectively on concentric circles with their centers at the center of the damper are different in modulus of elasticity with respect to a direction perpendicular to the surface of the damper from each other.

5 Claims, 8 Drawing Sheets

DAMPER FOR LOUDSPEAKER

BACKGROUND OF THE INVENTION

1. Field of the Invention

The present invention relates to a sound reproducing loudspeaker and, more particularly, to a damper for supporting the vibratory system including a diaphragm of a sound reproducing loudspeaker.

2. Description of the Prior Art

Referring to FIG. 15 showing a conventional sound reproducing loudspeaker in a sectional view, there are shown a magnetic circuit element 1 of a magnetic material having a central projection 1*a* at its center, a ring-shaped magnet 2 attached to the upper surface of the periphery of the magnetic circuit element 1, a flat ring-shaped pole piece 3 attached to the upper surface of the magnet 2, a conical speaker frame 4 having a lower end fixed to the upper surface of the pole piece 3 and expanding upward, a bobbin 5 put over the projection 1*a* so as to surround the projection 1*a*, a conical diaphragm 6 having a lower edge joined to the circumference of the upper end of the bobbin 5, and an upper edge joined to the upper edge of the speaker frame 4 with an edge member 7, a dust cap 8 attached to the diaphragm 6 so as to cover the upper part of the bobbin 5, a voice coil 9 wound around the lower end of the bobbin 5 opposite to the inner circumference of the pole piece 3, and a damper 10 placed substantially horizontally between and joined to the outer circumference of the bobbin 5 and the inner circumference of the speaker frame 4.

As shown in FIGS. 16 and 17, the damper 10 is a substantially ring-shaped plate having radially alternate circular ridges and circular furrows. The damper 10 is formed by impregnating a piece of woven fabric consisting of meshed fibers R and S extending along an X-axis and a Y-axis respectively as shown in FIG. 16 with a resin, and then forming the resin-impregnated piece of woven fabric in a wave shape.

In operation, an acoustic reproducing signal is supplied to the voice coil 9 of the sound reproducing loudspeaker. Then, the diaphragm 6 vibrates according to the varying intensity of the acoustic signal to convert vibrational energy into sound energy. The diaphragm 6 is held mechanically by the edge member 7 and the damper 10. The amplitude of vibration of the diaphragm 6 is dependent on the intensity of the current flowing through the voice coil 9. The respective displacements of the edge member 7 and the damper 10 are generated proportionally to the vibrational energy of the diaphragm 6.

Generally, when the diaphragm 6 vibrates, the damper 10 is required to meet antinomic conditions that the displacement of the damper 10 supporting the diaphragm 6 is proportional to the amplitude of the diaphragm when the amplitude is comparatively small and that the damper will not damp the vibrations when the amplitude of the vibration of the diaphragm 6 is nearly equal to a limit amplitude. Therefore, if importance is attached to damping ability, the damper 10 will not be displaced correctly according to the variation of the current flowing through the voice coil 9 when the amplitude is comparatively small.

When the meshed component yarns R and S of the damper 10 are extended along the X-axis and the Y-axis respectively, the moduli of elasticity in the direction of bending at portions of the damper around lines extending at an angle of 45° to the X-axis and the Y-axis is higher than that of other portions, and deformation rigidity thereabouts is also higher than that of other portions. FIG. 18 shows the distribution of modulus of elasticity on the damper 10. As is obvious from FIG. 18, the moduli of elasticity on inner circles are greater than those on outer circles, and modulus of elasticity increases gradually with angle from the X-axis and the Y-axis from a normalized value 1 on the X-axis and the Y-axis and reaches a maximum greater than the normalized value 1 at a position on lines at an angle of 45° to the X-axis and the Y-axis. Since the inner periphery 10*a* of the damper 10 is close to the source of vibrational energy as shown in FIG. 17, it is desirable to form the inner periphery 10*a* of the damper 10 in a construction having a high strength and a high flexural rigidity.

In the conventional sound reproducing loudspeaker thus constructed, in some cases, the diaphragm 6 is not displaced in proportion to the intensity of the current flowing through the voice coil 9 to vibrate the diaphragm 6 due to irregular strength distribution on the damper 10 and the insufficient strength of the inner periphery 10*a* of the damper 10. Furthermore, the forward movement and the rearward movement of the diaphragm 6 along the longitudinal axis differ from each other when the diaphragm 6 vibrates in longitudinal directions causing hysteresis and, consequently, vibrational linearity cannot be secured.

In particular, when the damper 10 has an irregular strength distribution and the resolution of the central part of the damper 10 for discerning acoustic signals in a range of minute vibrations from each other is deteriorated, sounds and voices having large amplitude cannot be reproduced in a high fidelity due to the aforementioned hysteresis. Techniques analogous with those connected with this conventional sound reproducing loudspeaker are disclosed in Japanese Patent Laid-open (Kokai) No. 6-62494.

SUMMARY OF THE INVENTION

In view of those problems in the conventional loudspeaker, it is a first object of the present invention to provide a damper for a loudspeaker, capable of being displaced in improved linearity of the amount of displacement to the vibrational energy exerted thereon and of enabling the loudspeaker to reproduce sounds in a high fidelity.

A second object of the present invention is to provide a damper for a loudspeaker, capable of being firmly and surely joined to the diaphragm of the loudspeaker at a part near a source of vibrational energy, and having an inner periphery having improved linearity in a range where the amplitude of vibration is small.

A third object of the present invention is to provide a damper for a loudspeaker, capable of being firmly and surely joined to the speaker frame of the loudspeaker, and having a modulus of elasticity suitable for sound reproduction at an intermediate part between the outer and the inner periphery thereof.

A fourth object of the present invention is to provide a damper for a loudspeaker, capable of securing linearity of modulus of elasticity in radial directions and overall modulus of elasticity.

A fifth object of the present invention is to provide a damper for a loudspeaker, capable of securing linearity of displacements on circular directions.

A sixth object of the present invention is to provide a damper for a loudspeaker, having a substantially constant modulus of elasticity on circular directions.

A seventh object of the present invention is to provide a damper for a loudspeaker, capable of improving linearity of displacements to the amplitudes of input signals.

An eighth object of the present invention is to provide a damper for a loudspeaker, capable of improving linearity of modulus of elasticity on each circular direction.

A ninth object of the present invention is to provide a damper for a loudspeaker, capable of enabling optional and easy adjustment and determination of the distribution of modulus of elasticity.

A tenth object of the present invention is to provide a damper for a loudspeaker, having portions having a reduced modulus of elasticity to secure the general linearity of modulus of elasticity on circular directions.

With the foregoing objects in view, in a first aspect of the present invention, a damper for a loudspeaker has substantially equal moduli of elasticity with respect to a direction perpendicular to the surface thereof at positions on a circle with its center at the center of the damper, and different moduli of elasticity with respect to a direction perpendicular to the surface thereof at positions on different concentric circles with their centers at the center of the damper respectively.

As mentioned above, since the damper for a loudspeaker, in the first aspect of the present invention has substantially equal moduli of elasticity and equal strengths at positions on a circle with its center at the center of the damper, the points on the circle are displaced uniformly when a vibrational force is applied to the damper, the damper has well-balanced overall strength and makes possible high-fidelity sound reproduction.

In a second aspect of the present invention, a damper for a loudspeaker is formed such that the modulus of elasticity with respect to a direction perpendicular to the surface of the damper of at least the inner periphery is higher than that of an intermediate portion between the inner periphery and the outer periphery of the damper.

As mentioned above, since a portion of the damper for a loudspeaker, in the second aspect of the present invention, near the source of vibrational energy has an increased modulus of elasticity, the resolution of the damper for discerning input acoustic reproducing signals in a range of minute vibrations from each other is improved to make high-fidelity sound reproduction possible.

In a third aspect of the present invention, a damper for a loudspeaker is formed such that the modulus of elasticity with respect to a direction perpendicular to the surface of the damper of at least the outer periphery is higher than that of an intermediate portion between the inner periphery and the outer periphery of the damper.

As mentioned above, since the modulus of elasticity of the outer periphery of the damper for a loudspeaker, in the third aspect of the present invention is higher than that of the intermediate portion between the outer periphery and the inner periphery of the damper, vibrations of large amplitudes can be limited and linearity of the reproducing characteristic of the loudspeaker to various vibrations including those in a normal operating range can be improved.

In a fourth aspect of the present invention, a damper for a loudspeaker is formed such that the modulus of elasticity with respect to a direction perpendicular to the surface of the damper decreases gradually along a radial direction from the inner periphery toward the outer periphery of the damper.

As mentioned above, since the pitches of woven yarn of the damper for a loudspeaker, in the fourth aspect of the present invention are enlarged from the inner periphery toward the outer periphery or finer yarns are arranged in portions of the damper nearer to the outer periphery, the linearity of reduction of the modulus of elasticity along a radial direction is improved so that vibrations can smoothly propagate from the central portion toward the outer periphery of the damper.

In a fifth aspect of the present invention, a damper for a loudspeaker is formed by shaping a piece of woven fabric consisting of plural pieces of circumferential yarn and plural pieces of radial yarn substantially perpendicularly intersecting the circumferential yarn.

As mentioned above, since the damper for a loudspeaker, in the fifth aspect of the present invention is formed by shaping a piece of woven fabric consisting of circumferential yarn and radial yarn, the linearity of the strain on each circular section is improved and the overall strength of the damper can easily be balanced.

In a sixth aspect of the present invention, a damper for a loudspeaker is formed such that portions of a flat ring-shaped piece of woven fabric around plural pieces of warp yarn symmetric with each other with respect to a first straight line parallel to the warp yarn and passing the center of the ring-shaped piece of woven fabric, and at a first distance from the first straight line are of the same weave and are different in weave from portions of the ring-shaped piece of woven fabric at a second distance from the first straight line, and the weave of portions of the ring-shaped piece of woven fabric around plural pieces of weft yarn symmetric with each other with respect to a second straight line parallel to the weft yarn and passing the center of the ring-shaped piece of woven fabric and at a distance from the second straight line is the same as the weave of the portions around the warp yarn at the corresponding distance from the first straight line.

As mentioned above, the damper for a loudspeaker, in the sixth aspect of the present invention is formed by shaping a piece of woven fabric consisting of warp yarn and weft yarn perpendicularly intersecting the warp yarn, specified portions of the damper surrounding the inner periphery of the same are woven in a weave and a yarn pitch using plural pieces of yarn different from those of other portions to balance the overall strength, more particularly, the circumferential strength, in order that the amount of displacement caused by vibrational energy is uniform on a circle.

In a seventh aspect of the present invention, a damper for a loudspeaker is formed such that the adhesive resin content of a piece of woven fabric impregnated with an adhesive resin varies with distance from the inner periphery toward the outer periphery or the adhesive resin content of the piece of woven fabric impregnated with the adhesive resin in a specified portions of the damper is adjustable.

As mentioned above, in the damper for a loudspeaker, in the seventh aspect of the present invention, different portions of the damper are impregnated in different resin contents respectively by selectively impregnating an adhesive resin solutions of different concentrations into the portions respectively, for example, by using masks to change the distribution of modulus of elasticity optionally. Thus, the damper capable of smoothly propagating vibrations from the inner periphery toward the outer periphery can be fabricated at a low cost.

In an eighth aspect of the present invention, a damper for a loudspeaker is formed by press working or injection molding such that the thickness is adjustable to vary with distance from the inner periphery toward the outer periphery or specified portions are adjustable to be formed in specified thicknesses respectively.

As mentioned above, the damper for a loudspeaker, in the eighth aspect of the present invention is formed by press-working a paper workpiece or by injection-molding a molding material, such as a rubber material or a polyurethane resin, so that specified portions of the damper can be formed in desired thicknesses respectively, the overall strength of the damper can easily be balanced, and the linearity of modulus of elasticity on circles and in radial directions can be secured.

In a ninth aspect of the present invention, a damper for a loudspeaker is formed such that the component yarn is arranged in a close pitch in portions requiring an increased modulus of elasticity with respect to a direction perpendicular to the surface of the damper, and the component yarn is arranged in a distant pitch in portions requiring a reduced modulus of elasticity with respect to a direction perpendicular to the surface of the damper.

As mentioned above, the modulus of elasticity of portions of the damper for a loudspeaker, in the ninth aspect of the present invention can optionally be determined by selectively determining the pitches of the yarn in those portions.

In a tenth aspect of the present invention, a damper for a loudspeaker is formed such that thick yarn is used in portions requiring an increased modulus of elasticity with respect to a direction perpendicular to the surface of the damper, and fine yarn is used in portions requiring a reduced modulus of elasticity with respect to a direction perpendicular to the surface of the damper.

As mentioned above, the modulus of elasticity of portions of the damper for a loudspeaker, in the tenth aspect of the present invention can optionally be determined by selectively determining the thickness of the yarn in those portions.

In an eleventh aspect of the present invention, a damper for a loudspeaker is provided with at least one hole in each of portions on a circle where the modulus of elasticity changes.

As mentioned above, the damper in the eleventh aspect of the present invention is provided with holes to equalize the modulus of elasticity of portions on a circle substantially, and to enable a closed space covered with the damper to breathe so that the resistance of air against the vibration of the damper is reduced and the diaphragm of the loudspeaker is able to vibrate smoothly.

The above and other objects and the novel features of the present invention will become more apparent from the following description taken in connection with the accompanying drawings, which are for the purpose of description only and are not intended to limit the scope of the present invention.

DETAILED DESCRIPTION OF THE PREFERRED EMBODIMENTS

Preferred embodiments of the present invention will be described in detail hereinafter with reference to the accompanying drawings.

First Embodiment

Figure 1:
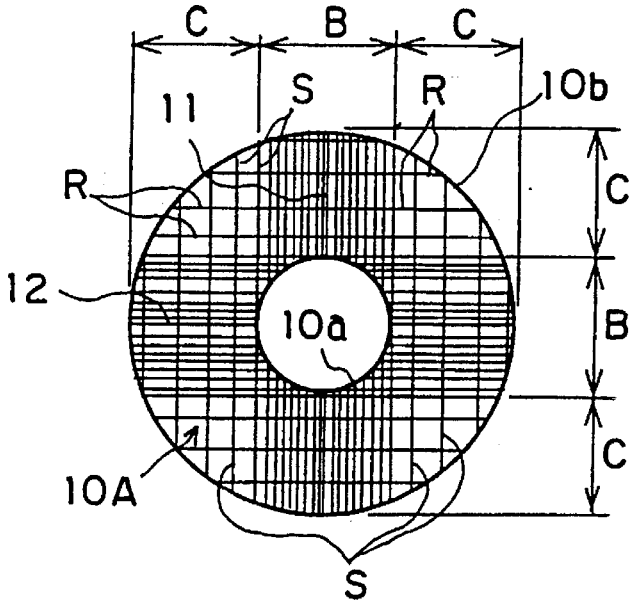
FIG. 1 is a plan view of a damper for a loudspeaker, in a first embodiment according to the present invention.
Figure 17:
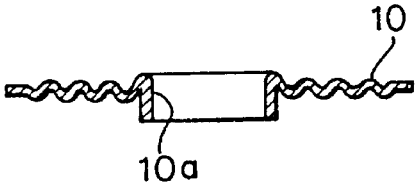
FIG. 17 (PRIOR ART)
FIG. 17 is a sectional view of the damper shown in FIG. 16.
Figure 18:
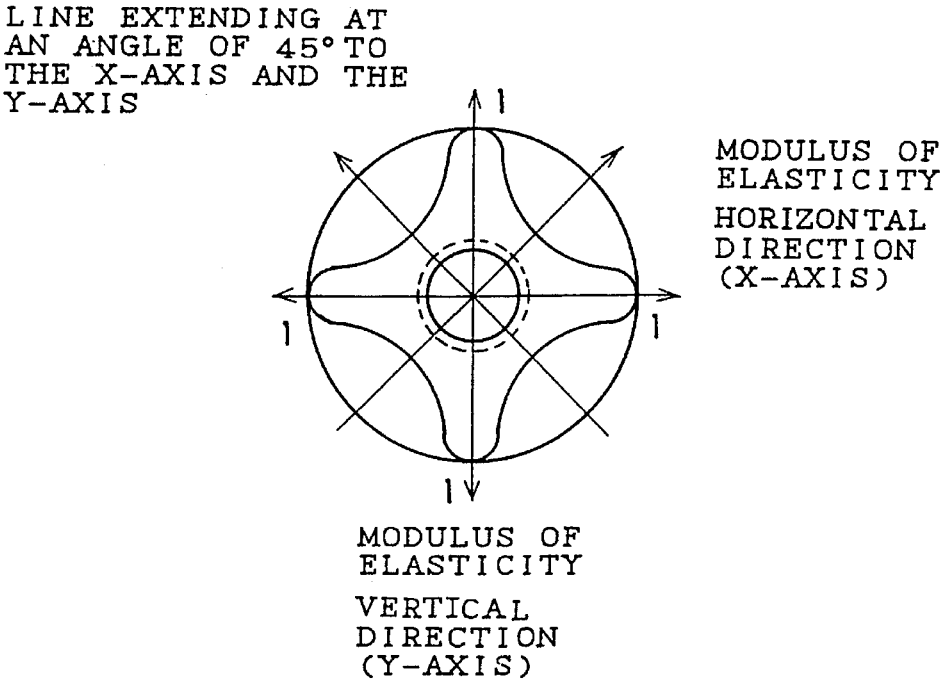
FIG. 18 (PRIOR ART)
FIG. 18 is an explanatory diagram of assistance in explaining the distribution of modulus of elasticity on the whole damper shown in FIG. 16.

Referring to FIG. 1 showing a damper 10A for a loudspeaker, in a first embodiment according to the present invention, the ring-shaped damper 10A is formed by shaping a piece of woven fabric consisting of warp yarn S and weft yarn R extending along the X-axis and the Y-axis respectively and impregnated with a resin (not shown) in a wavy shape as shown in FIG. 17. The warp yarn S and the weft yarn R are uniform in thickness over the entire length. The warp yarn S and the weft yarn R are arranged in a given close pitch width in a portion around the inner periphery 10*a*, and the pitch width is enlarged gradually from the portion around the inner periphery 10*a* toward the portion around the outer periphery 10*b*. The warp yarn S and the weft yarn R are arranged in a close pitch width in a vertical region B and a horizontal region B extending across the inner periphery 10*a*, and the warp yarn S and the weft yarn R are arranged in a pitch width enlarging toward the outer periphery 10*b* in regions C defined by the boundaries of the regions B and the outer periphery 10*b*.

Figure 2:
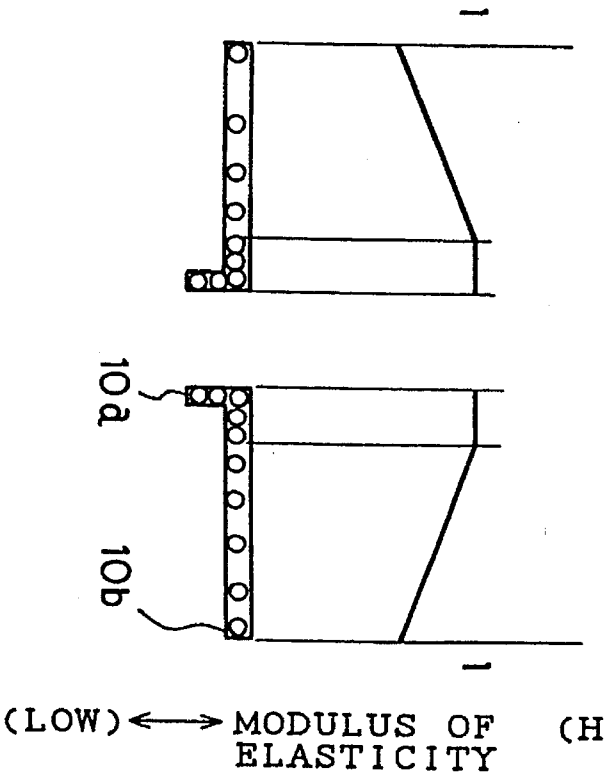
FIG. 2 is an explanatory diagram of the damper of FIG. 1, for assistance in explaining the variation of modulus of elasticity with distance along a line extending at an angle of about 45° to the X-axis and the Y-axis of an orthogonal coordinate system on the damper of FIG. 1.
Figure 3:
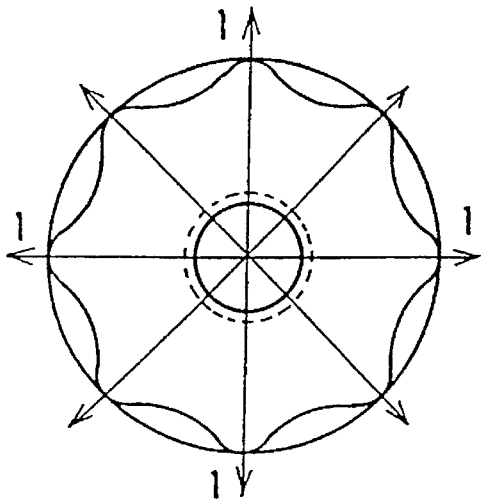
FIG. 3 is an explanatory diagram showing the distribution of modulus of elasticity on the damper of FIG. 1.

Therefore, the amount of fibers contained in the regions C, i.e., portions of the damper 10A around lines extending at an angle of 45° to the X-axis and the Y-axis is comparatively small and hence the modulus of elasticity of those regions C is substantially equal to the modulus of elasticity of the regions B around the X-axis and the Y-axis. Since the pitches of woven yarn of the regions around the lines extending at an angle of 45° to the X-axis and the Y-axis enlarges gradually from the inner periphery 10*a* toward the outer periphery 10*b*, the modulus of elasticity of the regions around the lines extending at an angle of 45° decreases gradually as shown in FIG. 2 and hence the damper 10A can easily be flexed. As shown in FIG. 3, the distribution of modulus of elasticity on a circle is substantially uniform, and the damper 10A has uniform elastic strength and an improved hysteresis characteristic. Consequently, the loudspeaker provided with the damper 10A is capable of reproducing sounds in a high fidelity and in a high sound quality.

It is desirable to use colored yarn, such as red yarn or blue yarn, as the warp yarn S on the Y-axis and the weft yarn R on the X-axis to facilitate the find of the center of the damper 10A corresponding to the intersection of the X-axis and the Y-axis when punching out the ring-shaped damper 10A from a die-formed resin-impregnated piece of woven fabric. The line corresponding to the warp yarn S passing the center of the ring-shaped damper 10A is a first straight line 11, and the line corresponding to the weft yarn R passing the center of the ring-shaped damper 10A is a second straight line 12. The pitch width of a portion where the regions B overlap each other is smaller than those of other portions and hence the portion has a high strength.

Second Embodiment

Figure 4:
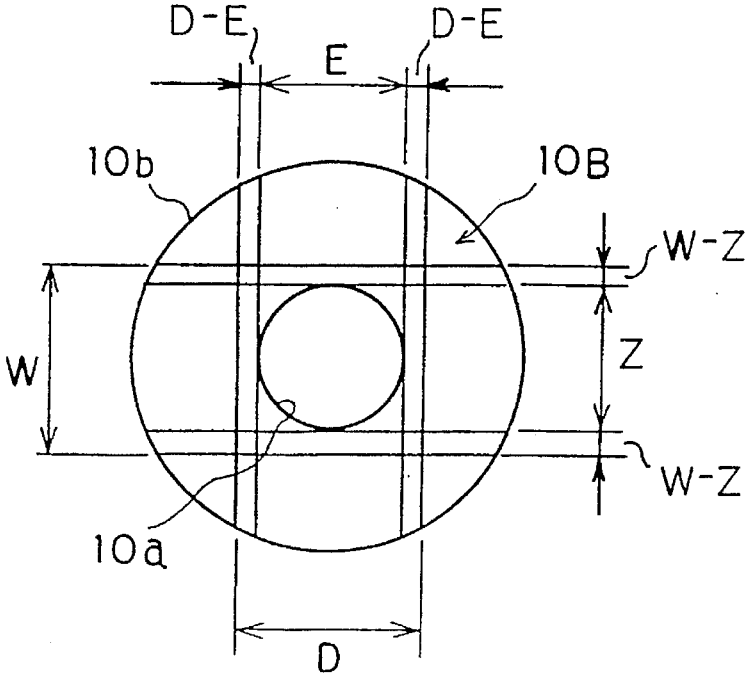
FIG. 4 is a plan view of a damper for a loudspeaker, in a second embodiment according to the present invention.

FIG. 4 is a plan view of a damper 10B in a second embodiment according to the present invention. In the damper 10B, a vertical region E and a horizontal region Z extend vertically and horizontally, respectively, across the inner periphery 10*a* of the damper 10B, and a vertical region D and a horizontal region W extend vertically and horizontally, respectively, across the inner periphery 10*a* and have a width greater than that of the horizontal region Z and the vertical region E. The strength of regions D–E between the outer boundaries of the regions E and those of the regions D and the strength of regions W–Z is enhanced by using yarn thicker than the yarn used in other regions, or by arranging the yarn in a larger pitch width than those in other regions. Thus, comparatively high modulus of elasticity can be obtained at a portion of the damper 10B close to where the voice coil 9, i.e., a source of vibrational energy, of the loudspeaker, so that the damper 10B can firmly be joined to the diaphragm 6 of the loudspeaker. Since the flexural rigidity of the inner periphery 10*a* of the damper 10B is enhanced sufficiently, the ability of the loudspeaker to resolve and reproduce signals in the range of small vibrations can be improved, and small vibrations can efficiently be propagated from the inner portion through the intermediate portion toward the outer portion of the diaphragm 6 to achieve high-fidelity sound reproduction.

The elastic strength of the damper 10B in this embodiment, similarly to those of the damper 10A shown in FIG. 1, are substantially uniform on a circle, and further the damper 10B has the regions D, E, W and Z.

Third Embodiment

Figure 5:
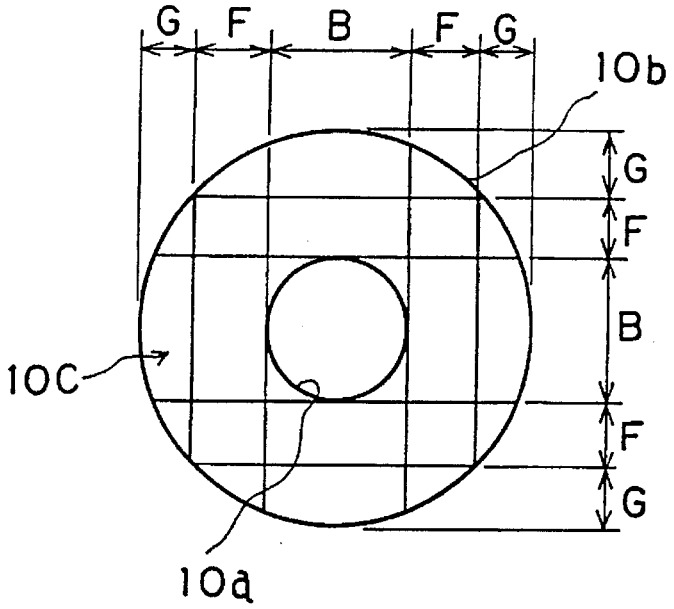
FIG. 5 is a plan view of a damper for a loudspeaker, in a third embodiment according to the present invention.

A ring-shaped damper 10C in a third embodiment according to the present invention shown in FIG. 5 is designed such that the linearity of the amount of strain of portions around lines extending at an angle of about 45° to the X-axis and the Y-axis is secured and the outer periphery has an increased flexural rigidity.

This damper 10C has regions B of a given width extending vertically and horizontally, respectively, across the inner periphery 10*a*, vertical and horizontal segment regions G dividing the outer periphery 10*b* by a specified width, and intermediate regions F surrounded by the regions B and the segment regions G. The flexural rigidities of the regions B and G are higher than that of the regions F. Accordingly, sufficiently high strength can be secured for the joint of a vibrating system including the diaphragm 6, and the speaker frame 4.

The flexural rigidities of those regions can easily and optionally be determined by selectively determining the weaving pitches of yarn in those regions and/or the thickness of the yarn contained in those regions. For example, when those regions are formed in different weaving pitches respectively, modulus of elasticity is distributed in a portion around a line extending at an angle of 45° to the X-axis and the Y-axis as shown in FIG. 6, in which the moduli of elasticity of the regions B and G are constant and higher than that of the regions F.

Figure 6:
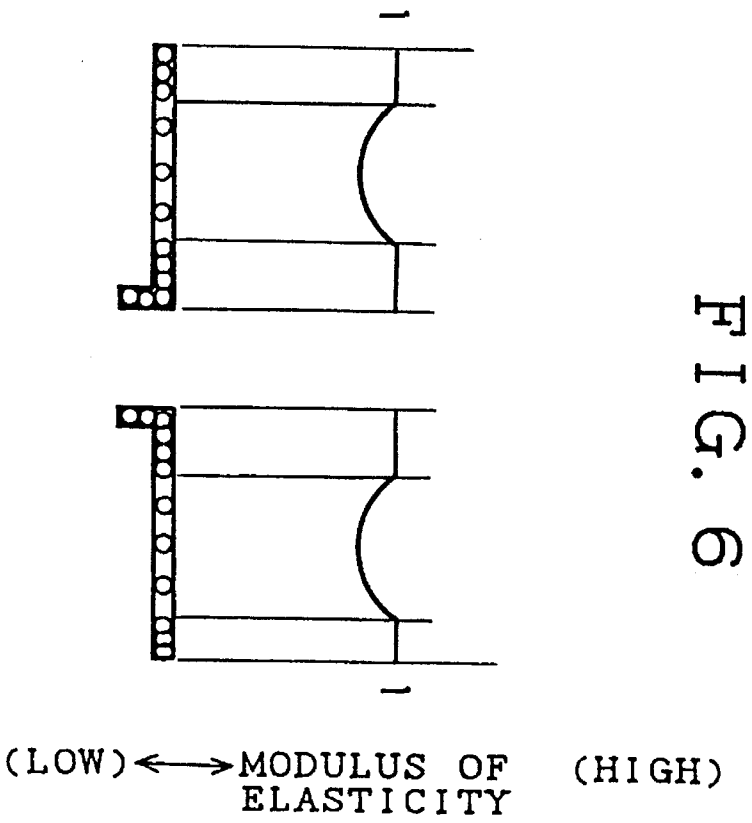
FIG. 6 is an explanatory diagram of the damper of FIG. 5, for assistance in explaining the variation of modulus of elasticity with distance along a line extending at an angle of about 45° to the X-axis and the Y-axis of an orthogonal coordinate system on the damper of FIG. 5.

The modulus of elasticity of the regions F varies along curves as shown in FIG. 6; the modulus of elasticity of portions of the regions F nearer to the regions B and G is higher than that of portions of the same farther from the regions B and G. Since the modulus of elasticity of the regions F is comparatively low, the regions can easily be flexed and the distributions of elastic strength on a circle in the regions F are substantially uniform, i.e., the regions F have a linear flexural characteristic.

The segment regions G having a comparatively high modulus of elasticity is effective in improving the linearity of flexural rigidity on a circle and in limiting vibrations of excessively large amplitude when input sound signal of large amplitude is applied to the loudspeaker, when the loudspeaker is, for example, used exclusively for reproducing low frequency sounds of large power. Thus, the linearity of vibrations in a wide amplitude range from a small amplitude to a large amplitude can be improved and the deterioration of sound quality in the normal operating range can be prevented.

Fourth Embodiment

The weaving pitches of yarn may be enlarged gradually toward the outer periphery in the regions C of FIG. 1, the regions of FIG. 4 excluding the regions D–E, and the regions F of FIG. 5 or thinner yarn may be arranged in portions of those regions nearer to the outer periphery 10*b* in addition to the variation of the weaving pitches or independently of the variation. Such an arrangement of yarn or the use of such yarn of different thicknesses further improves the linearity of the modulus of elasticity on in radial directions. If need be, yarn of different thicknesses may randomly be arranged in portions between the inner periphery 10*a* and the outer periphery 10*b* for the fine adjustment of the distribution of flexural rigidity on a circle.

Fifth Embodiment

As is generally known, when fabricating the dampers in the foregoing embodiments, a woven fabric is impregnated with a resin to fix the component yarn, and the resin content is determined selectively to obtain a damper having a desired hardness. Although this method of impregnating the woven fabric with a resin is able to determine the overall hardness of the damper, the method is unable to impregnate the woven fabric with the resin so that the central portion and the peripheral portion of the damper are different in hardness from each other. Therefore, this method is unable to improve the linearity of modulus of elasticity on a circle and in radial directions because the respective hardness of the central portion and the peripheral portion of the damper is equal to each other.

Figure 7:
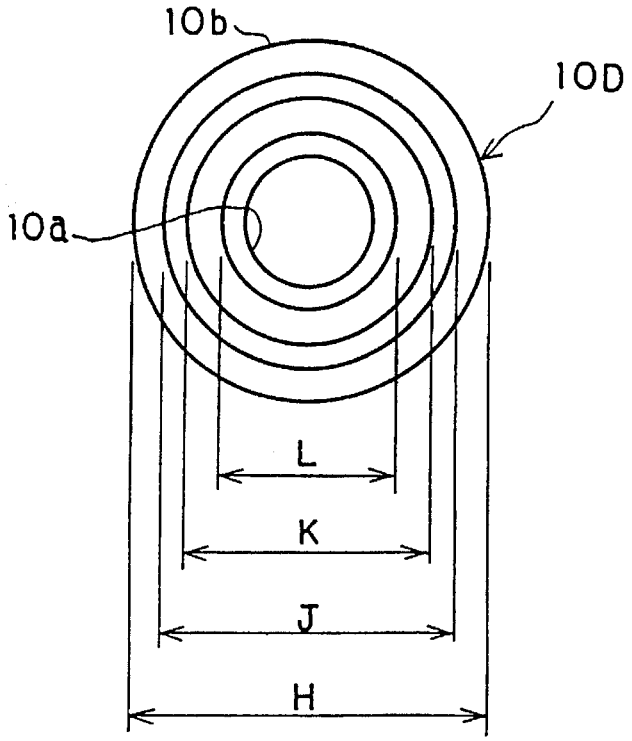
FIG. 7 is a plan view of a damper for a loudspeaker, in fifth embodiment according to the present invention.

When impregnating a workpiece with a resin to form a damper 10D in the fifth embodiment, a portion of the workpiece nearer to the outer periphery 10*b* is impregnated with a resin solutions in a lower resin content and a portion of the workpiece nearer to the inner periphery 10*a* is impregnated with a resin solution in a higher resin content so that the resin content of the damper 10D decreases gradually toward the outer periphery 10*b* at a resin content gradient as shown in FIG. 7.

More concretely, when impregnating the damper 10D with a resin, for example, the damper 10D is impregnated entirely with a resin solution of a resin concentration suitable for impregnating a portion near the outer periphery 10*b* in a desired resin content for the first impregnating cycle, a region H–J, i.e., an annular region between circles It and J, is masked and the damper 10D is impregnated with the same resin solution for the second impregnating cycle, a region H–K, i.e., an annular region between circles H and K, is masked and the damper 10D is impregnated with the same resin solution for the third impregnating cycle, and then a region H–L, i.e., a region between circles H and L, is masked and the damper 10D is impregnated with the same resin solution for the fourth impregnating cycle. Thus, the impregnating cycle is repeated necessary times to impregnated the damper 10D so that the resin content of the damper 10D decreases gradually toward the outer periphery 10*b*. The damper 10D thus fabricated, similarly to the damper 10A in the first embodiment, has an improved linearity of amplitude of vibration to strain. If need be, the resin content may be changed locally or specified portions of the damper 10D may be impregnated with different resins respectively for the fine adjustment of the flexural rigidity with respect to a circumferential direction.

Sixth Embodiment

Figure 8:
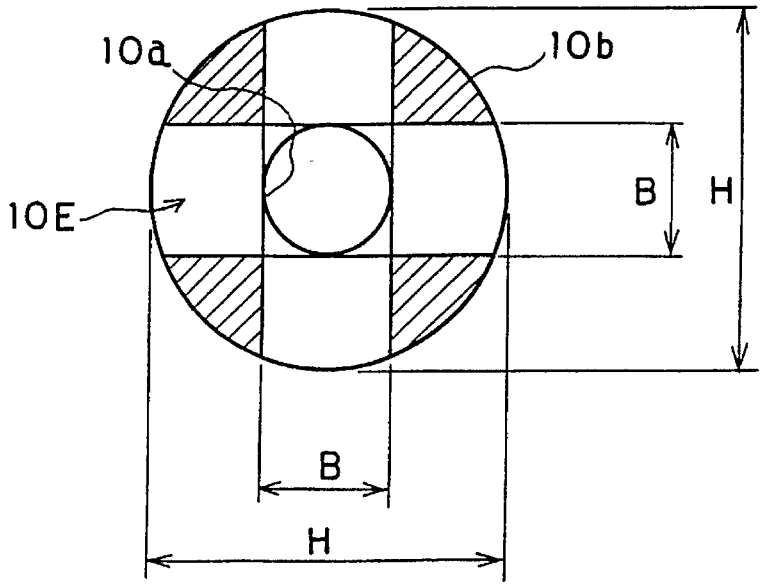
FIG. 8 is a plan view of a damper for a loudspeaker, in a sixth embodiment according to the present invention.

FIG. 8 is a plan view of a damper 10E for a loudspeaker, in a sixth embodiment according to the present invention. In this embodiment, the modulus of elasticity of portions of the ring-shaped damper 10E around lines extending at an angle of about 45° to the X-axis and the Y-axis is adjusted so that the overall modulus of elasticity on a circle is uniform (linear).

When fabricating the damper 10E, portions of a workpiece cut out from a conventional woven fabric consisting of warp yarn arranged in a uniform weaving pitch and weft yarn arranged in a uniform weaving pitch are only impregnated with a resin in different resin contents respectively to obtain the damper 10E having uniform overall modulus of elasticity on a circle. More concretely, first the workpiece is impregnated entirely with a resin solution by a conventional method, regions H–B demarcated by a pair of horizontal lines demarcating a horizontal region B, a pair of vertical lines demarcating a vertical region B and the outer periphery 10*b* of the workpiece are masked, and then the regions B are impregnated again with a resin solution so that flexural rigidity on a circle is uniform. The damper 10E having balanced overall strength can be fabricated at a comparatively low cost by thus selectively impregnating only regions having different modulus of elasticity with the resin.

Seventh Embodiment

Figure 9:
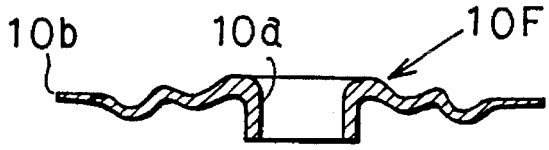
FIG. 9 is a sectional view of a damper for a loudspeaker, in a seventh embodiment according to the present invention.

FIG. 9 is a sectional view of a damper 10F for a loudspeaker, in a seventh embodiment according to the present invention.

When fabricating the damper 10F, a workpiece cut out from a woven fabric is impregnated with a resin by a conventional method, and then the resin-impregnated workpiece is shaped in a wavy shape as shown in FIG. 9 with a special die by press working or injection molding. This damper 10F has thickness decreasing from the inner periphery 10*a* toward the outer periphery 10*b*. The special die has a cavity of a desired shape formed between the upper and the lower half thereof. Therefore, the workpiece can be shaped in a desired shape as shown in FIG. 9 even if the workpiece has a uniform thickness. The hysteresis characteristic of the damper 10F having such thickness decreasing toward the outer periphery 10*b* at the time of straining totally can be improved by processing the damper 10F by the technique for adjusting the local resin content as described in connection with the damper 10D shown in FIG. 7. The overall strength of the damper 10F can be balanced by locally changing the thickness.

Figure 10:
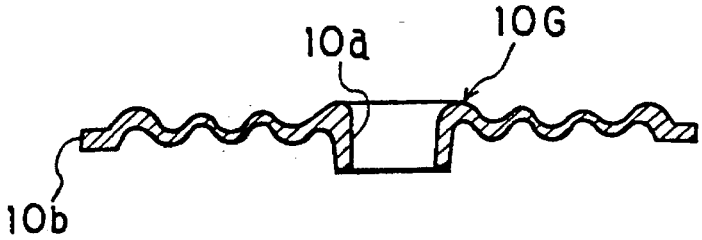
FIG. 10 is a sectional view of a damper for loudspeaker, in a seventh embodiment according to the present invention.

One suitable damper 10G has thickness large in the inner periphery 10*a* and the outer periphery 10*b* and small in the intermediate portion between the peripheries 10*a* and 10*b* as shown in FIG. 10. This shape of the damper 10G improves also the strength of the joint to both of the diaphragm 6 and the outer circumference of the frame. Since the modulus of elasticity of the intermediate portion between the inner periphery 10*a* and the outer periphery 10*b* is reduced, the damper 10G can easily be bent and elastic strength on a circle is uniform. The vibration of the outer periphery 10*b* in an excessively large amplitude can be suppressed when the input vibration has a large amplitude, and linearity in the range of a small amplitude to a large amplitude can be improved.

The damper 10F or 10G may be formed by injection-molding a molding material, such as a rubber material or a polyurethane resin, in a shape as shown in FIG. 9 or a shape having thickness large in the inner periphery 10*a* and the outer periphery 10*b* and small in the intermediate portion between the peripheries 10*a* and 10*b* as shown in FIG. 10 instead of shaping a piece of woven fabric.

Eighth Embodiment

Figure 11:
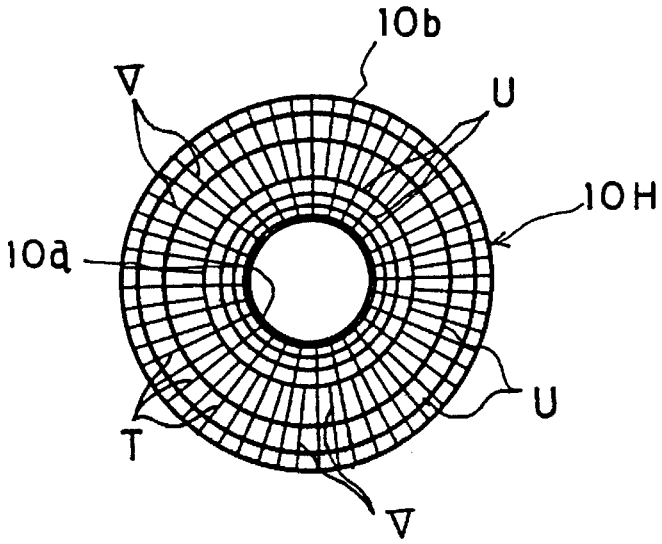
FIG. 11 is a plan view of a damper for a loudspeaker, in an eighth embodiment according to the present invention.
Figure 12:
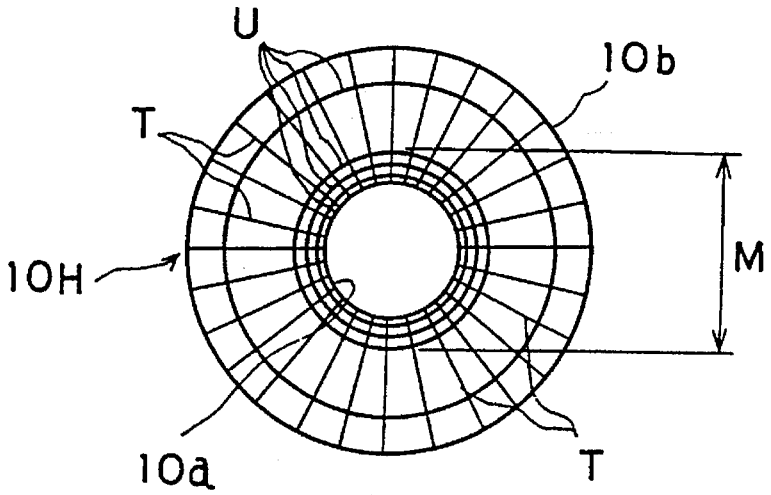
FIG. 12 is a plan view of a damper in a modification of the damper shown in FIG. 11.
Figure 13:
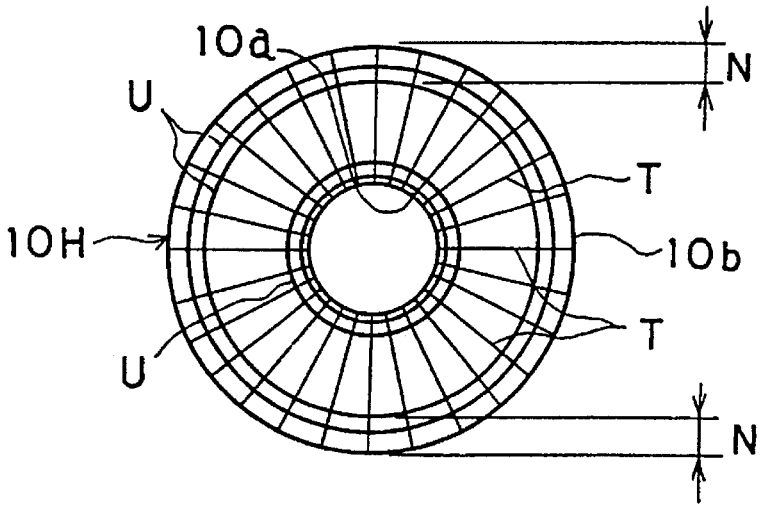
FIG. 13 is a plan view of a damper in another modification of the damper shown in FIG. 11.

FIGS. 11, 12 and 13 are plan views of a damper 10H for a loudspeaker, in an eighth embodiment according to the present invention. In the damper 10H in this embodiment, plural pieces of yarn are extended radially to improve the linearity of strain on a circle.

Referring to FIG. 11, the number and the length of warp yarn T radially extending from the inner periphery 10*a* are determined selectively to adjust the overall circumferential strength, and the positions of weft yarn U extended on concentric circles are determined selectively to adjust the overall strength.

For example, the density of the weft yarn U in a predetermined region M near the inner periphery 10*a* is increased relative to that of the weft yarn U in a region near the outer periphery 10*b* as shown in FIG. 12 to enhance the strength of the predetermined region M, and the density of the weft yarn U in the outer periphery 10*b* is reduced relatively to balance the overall strength.

The density of the weft yarn is decreased in proportion to distance from the inner periphery 10*a* to the intermediate portion between the inner periphery 10*a* and the outer periphery 10*b* and then increased in proportion to distance from the intermediate portion toward the outer periphery 10*b* so that the weft yarn are arranged in an increased yarn density in a region N near the outer periphery 10*b* as shown in FIG. 13 to secure strength of supporting the damper to the frame 4.

The overall strength of the damper 10H can be balanced by using warp yarn V radially extending in the outer periphery 10*b* and warp yarn T radially extending from the inner periphery 10*a* having different thicknesses respectively as shown in FIG. 11. The overall strength of the damper 10H can be balanced and the modulus of elasticity of the damper 10H can be adjusted to an optimum value by arranging thinner weft yarn U in radially outer regions, or enlarging the weaving pitches of the weft yarn U toward the outer periphery 10*b*. The application of the technique described previously in connection with the damper 10D shown in FIG. 7 in addition .to those measures further enhances the effects of those measures to provide the damper 10H having ideal properties.

Ninth Embodiment

Figure 14:
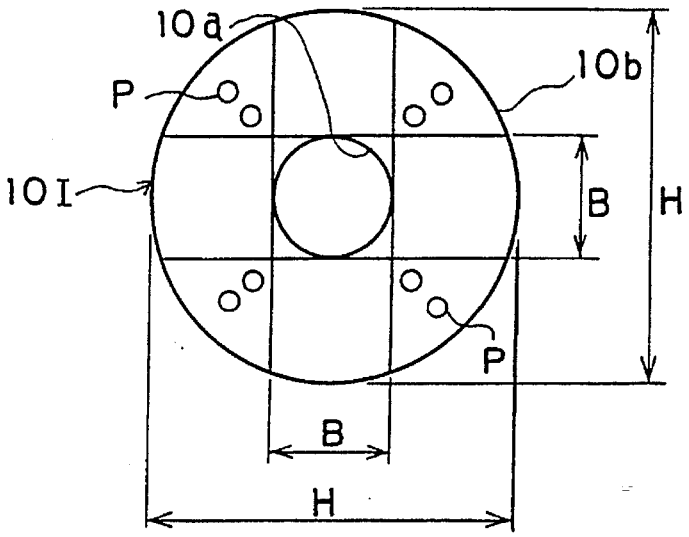
FIG. 14 is a plan view of a damper for a loudspeaker, in a ninth embodiment according to the present invention.
Figure 15:
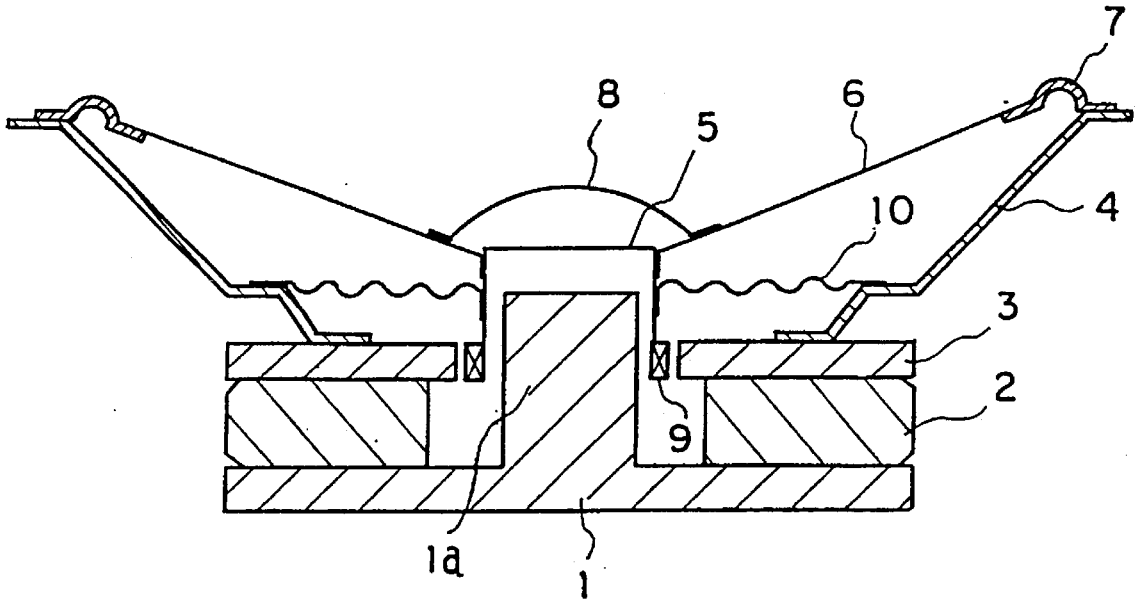
FIG. 15 (PRIOR ART)
FIG. 15 is a sectional view of a conventional sound reproducing loudspeaker.
Figure 16:
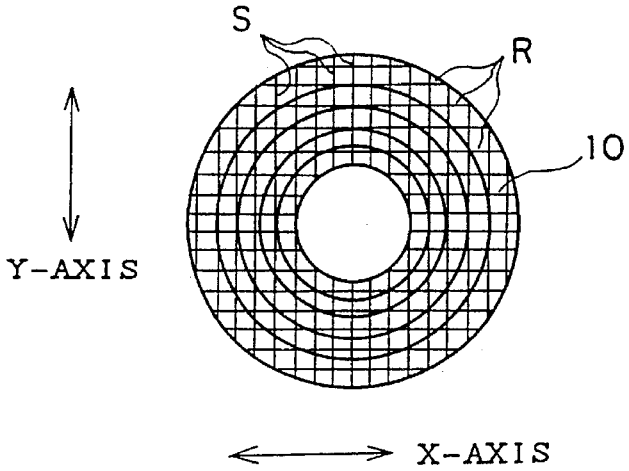
FIG. 16 (PRIOR ART)
FIG. 16 is a plan view of a damper incorporated into the loudspeaker of FIG. 15.

FIG. 14 is a damper 10I for a loudspeaker, in a ninth embodiment according to the present invention. As mentioned above, the modulus of elasticity of portions of the damper around lines extending at an angle of about 45° to the X-axis and the Y-axis is particularly high and those portions are difficult to bend.

As shown in FIG. 14, the damper 10I in this embodiment is provided with a plurality of holes P (or a single hole) in each of regions H–B defined by a horizontal region B horizontally extending through the inner periphery 10*a*, a vertical region B vertically extending through the inner periphery 10*a*, and the outer periphery 10*b* to adjust the strength on a circle in the regions H–B. The shape and the number of the holes P may selectively be determined according to the characteristics of the material forming the damper 10I, and the difference in modulus of elasticity between portions on circles of different radii.

The damper 10I in this embodiment can easily be fabricate at a very low cost. The technique employed in this embodiment can be used in combination with those employed in the first to the eighth embodiment if necessary for the fine adjustment of strength and modulus of elasticity.

As is apparent from the foregoing description, according to the first aspect of the present invention, since the moduli of elasticity with respect to a direction perpendicular to the surface of the damper of portions on a circle with its center at the center of the damper are substantially equal to each other, and the moduli of elasticity with respect to a direction perpendicular to the surface of the damper of portions on different concentric circles with their center at the center of the damper are different from each other, the damper has improved linearity of the amount of strain of the damper to vibrational energy exerted on the damper at the time of being displaced by the vibrational energy and the damper enables high-fidelity sound reproduction.

According to the second aspect of the present invention, since the modulus of elasticity with respect to a direction perpendicular to the surface of the damper of at least the inner periphery is higher than that of the intermediate portion between the inner periphery and the outer periphery, a portion of the damper near the source of vibrational energy can firmly and surely be joined to the diaphragm, and the signal resolution and the signal reproducing performance of the inner periphery can be improved.

According to the third aspect of the present invention, since the modulus of elasticity with respect to a direction perpendicular to the surface of the damper of at least the outer periphery is higher than that of the intermediate portion between the inner periphery and the outer periphery, the strength of the joint of the damper and the speaker frame is enhanced sufficiently, and the intermediate portion between the inner periphery and the outer periphery secures strength and modulus of elasticity suitable for sound reproduction.

According to the fourth aspect of the present invention, since the modulus of elasticity with respect to a direction perpendicular to the surface of the damper is gradually decreased with radial distance from the inner periphery toward the outer periphery, the linearity of the modulus of elasticity with respect to a radial direction and the overall modulus of elasticity of the damper can be secured by using yarn having proper thickness, by selectively determining a weaving pitch of yarn or by properly adjusting resin content.

According to the fifth aspect of the present invention, since the damper is formed by shaping a piece of woven fabric consisting of plural pieces of circumferential yarn and plural pieces of radial yarn substantially perpendicularly intersecting the circumferential yarn, the linearity of strain on a circle can surely be secured.

According to the sixth aspect of the present invention, since the damper is formed such that portions of a flat ring-shaped piece of woven fabric around plural pieces of warp yarn symmetric with each other with respect to a first straight line parallel to the warp yarn and passing the center of the ring-shaped piece of woven fabric, and at a first distance from the first straight line are of the same weave, and are different in weave from portions of the ring-shaped piece of woven fabric at a second distance from the first straight line, and the weave of portions of the ring-shaped piece of woven fabric around plural pieces of weft yarn symmetric with each other with respect to a second straight line parallel to the weft yarn and passing the center of the ring-shaped piece of woven fabric, and at a distance from the second straight line is the same as the weave of the portions around the warp yarn at the corresponding distance from the first straight line, the damper can be formed so that the modulus of elasticity on a circle is substantially uniform by constructing the piece of woven fabric so that portions at the same distance from the center of the ring-shaped woven fabric are the same and portions at different distances from the center of the ring-shaped piece of woven fabric are different from each other in the thickness of the yarn and/or the weaving pitch of the yarn.

According to the seventh aspect of the present invention, the damper is impregnated with an adhesive resin such that the adhesive resin content of the damper varies with distance from the inner periphery toward the outer periphery of the damper or specified portions of the damper are impregnated with the adhesive resin in a specified adhesive resin content to improve the linearity of the amount of strain to the magnitude of the input signal by adjusting the adhesive resin content to be impregnated.

According to the eighth aspect of the present invention, the damper is formed by press working or injection molding such that the thickness is adjustable to vary with distance from the inner periphery toward the outer periphery or a specified portion of the damper is adjustable to be formed in a special thickness, so that expected variations of thickness in radial directions are formed by press working or injection molding, and the linearity of modulus of elasticity on a circle can easily be improved.

According to the ninth aspect of the present invention, the damper is formed such that the plural pieces of yarn are arranged in a close pitch in portions requiring comparatively high modulus of elasticity with respect to a direction perpendicular to the surface of the damper and the plural pieces of yarn are arranged in a comparatively distant pitch in portions requiring a comparatively low modulus of elasticity with respect to a direction perpendicular to the surface of the damper, so that the distribution and the value of modulus of elasticity can easily and optionally be determined by selectively determining the weaving pitches of the yarn.

According to the tenth aspect of the present invention, the damper is formed such that comparatively thick yarn is arranged in portions requiring comparatively high modulus of elasticity with respect to a direction perpendicular to the surface of the damper, and comparatively fine yarn is arranged in portions requiring comparatively low modulus of elasticity with respect to a direction perpendicular to the surface of the damper. Therefore, the distribution of modulus of elasticity and the value of modulus of elasticity can easily and optionally be determined by selectively determining the thickness of the yarn.

According to the eleventh aspect of the present invention, since the damper is provided with at least one hole in each of portions on a circle where modulus of elasticity changes, the linearity of the overall modulus of elasticity on a circle can be secured by reducing the modulus of elasticity of the portion.

While the preferred embodiments have been described, it is to be understood that the description is for illustrative purposes only and that changes and variations may be made therein without departing from the spirit and scope of the following claims.

What is claimed is:

1. A damper for a loudspeaker, comprising:

a main body having an aperture, said main body having an outer periphery portion connectable to a speaker frame of said loudspeaker and an inner periphery portion connectable to a vibration system of said loudspeaker, said loudspeaker having a diaphragm, and said inner periphery portion defining said aperture;

at least one horizontal region being formed in a horizontal direction of said main body, said at least one horizontal region reinforcing said inner periphery portion; and at least one vertical region being formed in a vertical direction of said main body, said at least one vertical region reinforcing said inner periphery portion.

2. A damper according to claim 1, wherein said at least one horizontal region and said at least one vertical region are made of yarn having a thickness larger than yarn in other regions of said main body to increase modulus of elasticity in a direction perpendicular to a surface of said main body.

3. A damper according to claim 1, wherein said main body is made of a woven material, and yarn at said at least one horizontal region and said at least one vertical region has a larger pitch width than in other regions of said main body to increase modulus of elasticity in a direction perpendicular to a surface of said main body.

4. A damper according to claim 1, wherein said main body includes two horizontal regions being formed parallel to each other, and two vertical regions being formed parallel to each other.

5. A damper according to claim 4, wherein said inner periphery portion has a circular shape having a diameter, and a distance between said two horizontal regions and said two vertical regions are about the same as said diameter.

* * * * *